United States Patent [19]

Collins

[11] 3,949,267

[45] Apr. 6, 1976

[54] PROTECTIVE STARTING CIRCUIT FOR INVERTER OPERATED GASEOUS DISCHARGE LAMPS

[75] Inventor: James R. Collins, Fort Wayne, Ind.

[73] Assignee: General Electric Company, Carmel, Ind.

[22] Filed: Apr. 15, 1975

[21] Appl. No.: 568,177

[52] U.S. Cl. ..... 315/203; 315/DIG. 7; 315/206

[51] Int. Cl.[2] ..... H05B 37/00; H05B 41/26; H05B 37/02

[58] Field of Search ..... 315/DIG. 7, 205, 208, 226, 315/283, 289, 200 R, 206, 204, 203, 168

[56] References Cited

UNITED STATES PATENTS

| | | | |
|---|---|---|---|
| 3,536,955 | 10/1970 | Sturdevant et al. | 315/200 R X |
| 3,789,266 | 1/1974 | Polman et al. | 315/DIG. 7 |

*Primary Examiner*—Robert Segal

[57] ABSTRACT

A circuit arrangement for starting a linear metal halide arc discharge lamp while in a transistor switching bridge inverter circuit. A pulse generator is electrically connected to a trigger electrode which is mounted in close proximity to the lamp for supplying pulsed high voltage. The trigger electrode is capacitively coupled to the lamp for supplying pulsed high voltage for starting the lamp. A first logic gate is connected in circuit between a pulse width modulator and a phase splitter driver and is responsive to lamp current to lock the driver in a constant mode until the lamp starts. A second logic gate is connected to the pulse generator and is responsive to lamp current to inhibit the generator when the lamp is on. The pulse width modulator produces, when enabled, a variable pulse train having a fast rise and fall time. This variable pulse train is delivered to the phase splitter driver within which is developed the signal for driving the inverter. A differential amplifier is responsive to the differences in light sensed at opposite ends of the lamp and is connected to the pulse width modulator to control its operation.

17 Claims, 3 Drawing Figures

PROTECTIVE STARTING CIRCUIT FOR INVERTER OPERATED GASEOUS DISCHARGE LAMPS

BACKGROUND OF THE INVENTION

I. Field of the Invention

The present invention relates to a starting circuit arrangement for gaseous discharge lamps, and more particularly to a circuit arrangement for starting a linear metal halide arc discharge lamp while the lamp is in a semi-conductor inverter circuit.

II. Description of the Prior Art

Gaseous discharge lamps of the long, linear multicomponent, metal halide type are extremely susceptible to cataphoretic effects. That is, the color of the radiated light may vary along the length of the lamp due to the influence of thermal and electrical gradients, and the like, which act to produce a non-uniform dispersion of light emitting cations in the arc discharge. Light feedback, closed-loop, electronic lamp current switching circuits have been devised to counteract these non-uniform dispersions. By controlling relative time of forward to reverse alternations of current in the lamp, it is possible to inject a DC current (superimposed on the AC current) which produces a cataphoretic bias of its own and can be poled so as to oppose the naturally occurring cataphoretic forces. It is possible to construct a circuit operating in such a negative light-feeback control system as described in U.S. Pat. No. 3,700,960 - Lake which will produce a uniform, axial, spectral energy density of light output for such lamps. One of the greatest difficulties facing designers has been in finding circuits which will reliably start such lamps without degrading or causing failure of the electronic switching apparatus needed to control cataphoresis as described.

In addition to being susceptible to cataphoresis effects, multicomponent metal halide lamps are difficult to start. The application of a very high ionizing voltage is required to initiate breakdown leading to a continuous arc discharge. Some have suggested that 8 and 12 Kv is required for starting. This writer, however, has found that, in pulse starting, crest voltages of 30 Kv with a typical rise time of one microsecond are required. This is not surprising since these are the typical parameters for pulse starting long linear arc discharge lamps of similar dimensions. U.S. Pat. No. 3,700,960 - Lake, assigned to the same assignee as the present invention, discloses a metal halide lamp system. With the system as disclosed therein in FIG. 5, a Tesla coil was used as the source of high voltage for initiating breakdown of the linear metal halide lamp. A plurality of bypass switches shown in FIG. 5 and totaling six in number are incorporated in circuit with the lamp 1 between DC input 11 and the circuit ground connection. These bypass switches are a set of mechanical contacts which serve to transfer aside and isolate the comparatively delicate semiconductor switching inverter switches from the deleterious effects of the high voltage starting pulses applied to the lamp during lamp starting.

Typically, the pulse starting voltage is 10 to 50 times greater than the blocking voltage rating of the highest voltage rated power transistors suitable for each leg of a bridge inverter such as that disclosed in the aforementioned Lake patent. One can easily see that the destruction of these transistors would be the general consequence of attempts to start the lamp were it to be directly connected to the bridge inverter without special protective provisions.

Another problem arises in a circuit as disclosed in the Lake patent, this problem also being solved by these six bypass switches. Since a tungsten filament, incandescent lamp is normally used as a resistor ballast in such a lamp circuit, it is necessary to bypass the lamp starting and warm-up current around the transistor bridge inverter. This is necessary because the inrush current of the incandescent lamp ballast and the warm-up characteristics of the lamp would cause a current at the beginning of operation much greater than the transistors could handle and instant destruction would ensue. Such a problem has been resolved by operating the lamp for the warm up period before attempting to switch over to operation by the transistor bridge inverter. Since lamp impedance increases roughly by a factor of 3 during warm up, this places lamp current in a range which the transistor inverter could handle. However, lamp starting by such a method has been rather precarious. Most of the failures have occurred at this time either by catastrophic failure of the transistor bridge or by lamp drop out because of a too long, zero lamp current transition. Furthermore, a serious consequence of this warm up method is the placement of a hard cataphoretic bias on such a linear metal halide lamp. This occurs because the bypass switches place the lamp into a DC operating mode. To counteract this mode after switchover by action of an opposed DC bias from an electronic control circuit to return the lamp to a uniform axial spectral distribution of light takes a very long time: 5 to 15 minutes. This is acknowledged to be fundamentally unacceptable for a practical system.

It is desirable therefore to provide a starting circuit arrangement for such a linear, multicomponent metal halide are discharge lamp which will start the lamp reliably, without need for manual attendance, and be so fast acting that no cataphoretic bias and resultant lamp color imbalance would occur. By the present invention, there is provided a circuit arrangement for starting such a linear, multicomponent metal halide arc discharge lamp while the lamp is in a semiconductor switching inverter circuit.

SUMMARY OF THE INVENTION

In accordance with the present invention, there is provided in an electrical circuit having a semi-conductor switching inverter for operating a gaseous discharge lamp from a DC energy source, a circuit arrangement for starting the lamp while in the inverter circuit. Included is a trigger electrode mounted in close proximity to the lamp for capacitively coupling pulsed high voltage to the lamp. A high voltage energy source is connected to the trigger electrode for supplying pulsed high voltage to the lamp. Means are provided for locking the inverter in a constantly conductive, single polarity output mode until the lamp starts.

In the preferred embodiment, there is further included means for preventing high voltage pulsing of the trigger electrode after lamp ionization while the inverter is free-running.

DESCRIPTION OF THE PREFERRED EMBODIMENT

Figure 1:
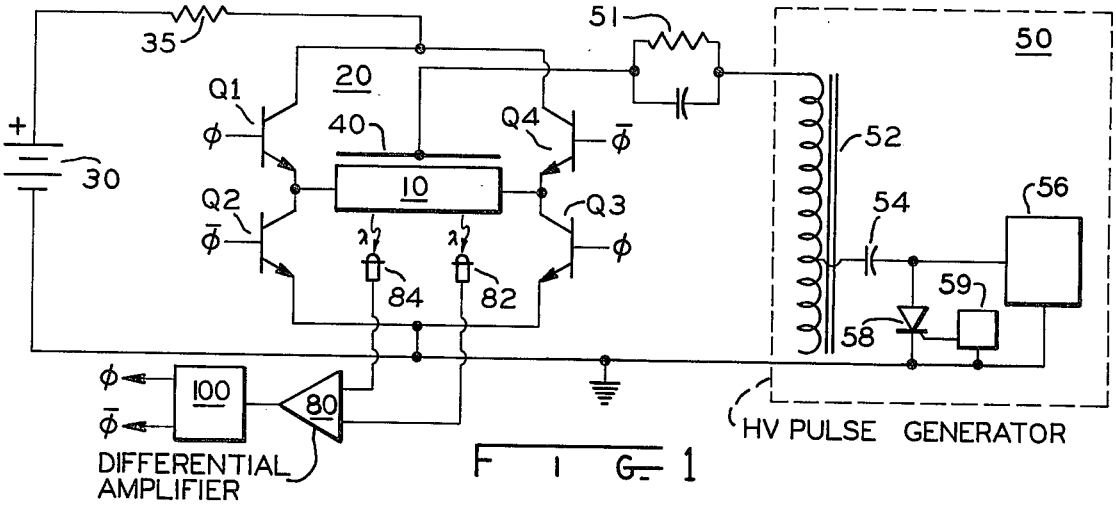
FIG. 1 is a basic schematic representation of a DC operated bridge inverter circuit for operating a linear metal halide lamp including a high voltage pulse generator forming a portion of the starting circuit arrangement of the present invention.
Figure 2:
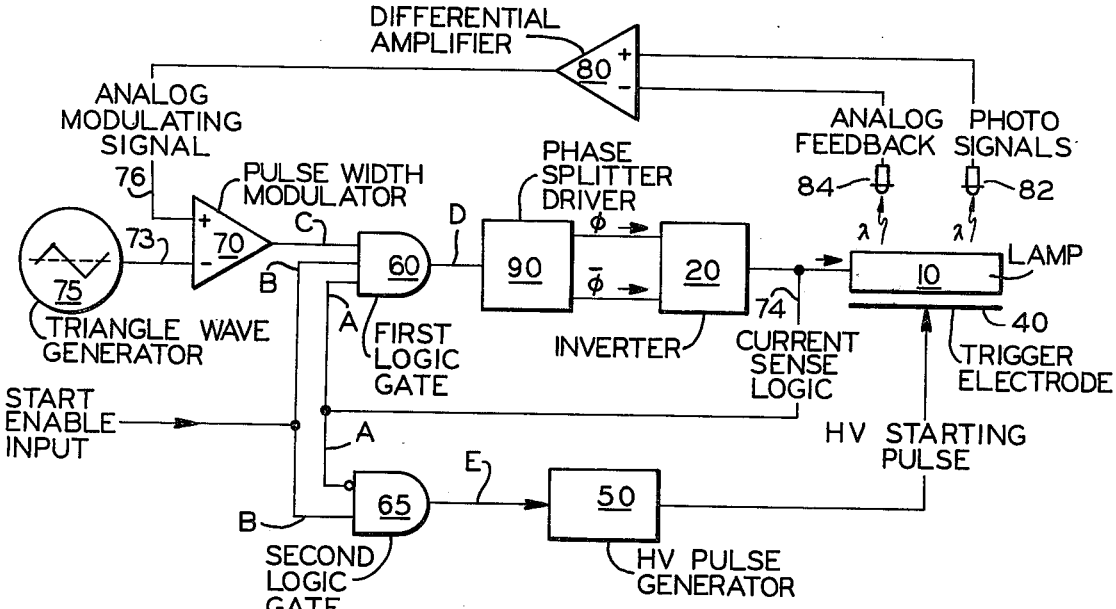
FIG. 2 is a block diagram of the starting circuit logic of the lamp starting circuit arrangement of the present invention.

Referring generally to FIGS. 1 and 2, there is shown, by schematic representation, a circuit arrangement useful for starting a gaseous discharge lamp, as for example, linear, multicomponent metal halide lamp 10. A semiconductor switching inverter 20 of the transistor bridge type functions to operate the lamp 10 and is connected to a DC electrical energy source 30. Transistor inverter 20 is of the high current switching type and may be of the type disclosed in U.S. Pat. No. 3,700,960 - Lake, assigned to the same assignee as the present invention.

Bridge inverter 20 includes transistor switches Q1, Q2, Q3 and Q4, the control of which may be had from light feedback controlled, timeratio polarity modulated, electronic switching circuits as disclosed in the aforementioned Lake patent, the operation of which is not essential to the present invention. A ballast resistor 35 provides the necessary ballasting for the operation of lamp 10, a negative resistance type device.

In accordance with the present invention, there is provided a circuit arrangement for starting the lamp 10 while in inverter circuit 20. A trigger electrode 40 is provided mounted in close proximity to lamp 10 for capacitively coupling pulsed high voltage to lamp 10. Also provided is a high voltage energy source such as high voltage pulse generator 50 connected to trigger electrode 40 for supplying pulsed high voltage to the lamp 10 by stray capacitance coupling. A coupling impedance 51 including the parallel combination of a resistor and a capacitor is coupled serially between the pulse generator 50 and the starting electrode 40.

High voltage pulse generator 50 may be of the capacitive discharge type as shown in FIG. 1. Included in pulse generator 50 is a pulse transformer 52 and a discharge capacitor 54. When a starting pulse is desired to be applied to trigger electrode 40, it is necessary to charge capacitor 54 from a second DC source 56. The charged capacitor 54 is then discharged by the action of a discharge thyristor 58 which is normally off but is triggered on by a gate trigger source 59. The discharge action of the capacitor 54 into the primary of the pulse transformer 52 coupled with the turns ratio action of the pulse transformer makes possible a transfer of the energy stored in the discharge capacitor 54 into lamp 10 at a high potential so as to ionize the lamp.

Also included in the starting circuit arrangement is means for locking the inverter 20 in a constantly conductive, single polarity output mode and includes first logic gate 60. Logic gate 60 prevents the switching of inverter 20 until the lamp 10 starts. That is, inverter 20 is either in the state whereby the Q1 and Q3 diagonal pair are conductive (and the Q2 and Q4 opposite diagonal pair are blocking), or in the state whereby the Q2 and Q4 diagonal pair are conductive (and the Q1 and Q3 opposite diagonal pair are blocking). By this means, it is intended during lamp starting that each lamp terminal be continuously connected to a low impedance point thereby clamping the maximum voltage at the lamp terminals to ground, or bridge positive input, which is connected to DC source 30 through resistor 35. Resistor 35 is a relatively low impedance compared to the source impedance of the lamp and starting pulse generator. Means are also provided for preventing high voltage pulsing of the trigger electrode 40 after lamp ionization while inverter 20 is free-running in this embodiment in the form of a second logic gate 65 serving to inhibit the high voltage energy source, high voltage pulse generator 50 when lamp 10 is operational. This is vitally important because the inverter 20 passes through a state at each lamp 10 current polarity reversal when all four switching transistors Q1, Q2, Q3 and Q4 are in the blocking state. This transition state is necessary to guarantee that vertical pair transistor switchthrough cannot exist such as transistor Q1 and Q2 (or Q3 and Q4) being "on" at the same instant. During this transition state lamp 10 terminals are not clamped and pulse voltages of 9Kv typically can exist and are sufficient to destroy the power transistor switches.

Referring specifically now to FIG. 2, there is shown a block diagram of the starting circuit logic of the lamp starting circuit arrangement of the present invention. However, it would seem necessary to first present a truth table for the respective logic gates:

| Logic Gate 60: | State | A | B | C | D |
|---|---|---|---|---|---|
| | 0 | 0 | 0 | 0 | 0 |
| HI = 1 | 1 | 1 | 0 | 0 | 0 |
| LO = 0 | 2 | 0 | 1 | 0 | 0 |
| | 3 | 1 | 1 | 0 | 0 |
| | 4 | 0 | 0 | 1 | 0 |
| | 5 | 1 | 0 | 1 | 0 |
| | 6 | 0 | 1 | 1 | 0 |
| | 7 | 1 | 1 | 1 | 1 |

| Logic Gate 65: | State | A | $\bar{A}$ | B | E |
|---|---|---|---|---|---|
| | 0 | 0 | 1 | 0 | 0 |
| | 1 | 1 | 0 | 0 | 0 |
| | 2 | 0 | 1 | 1 | 1 |
| | 3 | 1 | 0 | 1 | 0 |

It should be noted that when lamp 10 is on and inverter 20 is free running, logic gate 60 switches between states 3 and 7 and logic gate 65 is held in state 3. During lamp starting, logic gate 65 is in state 2.

Following is a description of the overall circuit and the sequence of events which occur in the starting of the lamp 10. A pulse width modulator 70 is the source of a fast rise and fall time pulse train when enabled. The output of pulse width modulator 70 appears on line C and is a pulse train with variable duty cycle controllable from a ratio of HI to LO time approaching zero to a HI to LO time approaching 100 percent. Modulator 70 is basically a simple voltage comparator whose output state is dependent upon the relative magnitude of a triangle wave input on line 73 from triangle wave generator 75, and an analog modulating signal input appearing on line 76 and received from a differential amplifier 80 responsive to the difference in light sensed at the opposite ends of the lamp load.

A pair of photosensors 82 and 84 are disposed at opposite ends of lamp 10 and are for light coupling thereto and provide inputs to differential amplifier 80. Further details of the operation may be had by reference to the above-mentioned Lake patent. Light sensors 82 and 84 are responsive to light radiation at the respective ends of the lamp 10. These sensors produce electrical signals which are fed in a differential connected input to differential amplifier 80. The output of amplifier 80 is fed to control terminal 76 of pulse width modulator 70 which is part of a bridge amplifier driving circuit 100 comprised of triangle wave generator 75, pulse width modulator 70, first logic gate 60, and phase splitter driver 90.

Figure 3:
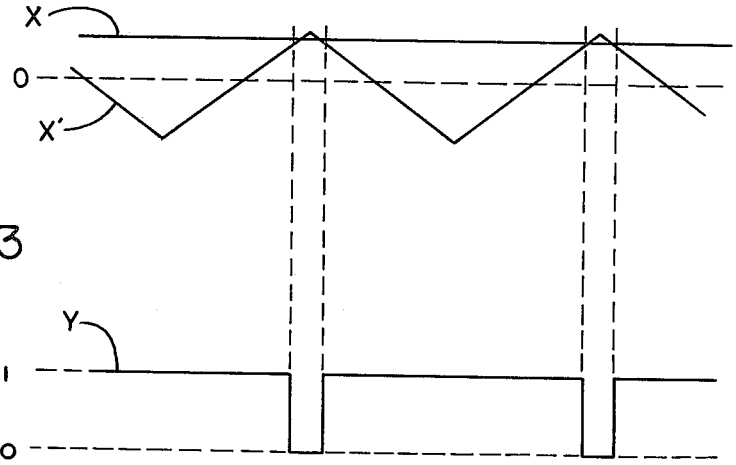
FIG. 3 is a graphical presentation showing the comparison of input signal to pulse train output for the pulse width modulator.

FIG. 3 explains the operation of pulse width modulator 70. A pulse train output Y from the pulse width modulator 70 is shown for the case of a positive modulating signal from the differential amplifier 80. Curve X represents a typical input signal to the non-inverting input and curve X′ represents a typical input signal to the inverting input of pulse width modulator 70. Anytime instantaneous X is more positive than instantaneous X′, the action of the pulse width modulator is to force the output to a logic level LO. The signal from amplifier 80 is a slowly varying signal compared to the frequency of the triangle wave generator 75. FIG. 3 shows that a positive modulating input signal produces an output pulse train whose duty cycle (the percent ratio of time at HI to the time at LO) is greater than 50 percent. When the modulating input signal is negative, the result is a duty cycle less than 50 percent. At zero level input modulating signal, the pulse train output is 50 percent. It should be noted that the logic line 74 sensing lamp current as the means for detecting the lamp "on" state could be replaced by a signal line from the photosensors 82 and 84.

As stated above, output from pulse width modulator 70 is fed through line 72 to first logic gate 60 thence to a phase splitter drive 90 in which is developed the necessary 180° out of phase signal and edge delays to drive the inverter 20 and to run the lamp 10. The presence of lamp current is sensed by some means such as a resistor (not shown), which tells the circuit that the lamp 10 is "on."

At the beginning of the lamp start cycle, lamp 10 is "off" and the start input is a LO. Lamp starting commences with a logic HI at the START ENABLE INPUT which enables the pulse width modulator 70. Lamp 10 is off and of course, the lamp current sense is a logic LO. This signal inhibits the pulse width modulator 70 from passing into the phase splitter driver 80, thus locking the driver 80, inverter 20 and lamp 10 into a DC mode. The same lamp current sense LO enables the high voltage pulse generator 50 which in turn acts to start the lamp. This situation will exist until lamp 10 ionizes and becomes operational. When lamp 10 starts, lamp current sense HI acts to enable the free running of the phase splitter driver 90 and to inhibit the high voltage pulse generator 50. By this means, an automatic and reliable lamp starting in a direct-coupled semiconductor inverter is achieved.

It should be observed that, in a physical implementation of this circuit, other forms, albeit more complicated, of combinatorial logic can be used. An example of this is the obvious case of an "operate enable input" which consists of a power line connection to the amplifying circuits in the logic circuits.

It should be apparent to those skilled in the art that the embodiment described heretofore is considered to be the presently preferred form of the invention. In accordance with the Patent Statutes, changes may be made in the disclosed apparatus and the manner in which it is used without actually departing from the true spirit and scope of this invention.

What I claim is new and desire to be secure by letters patent in the United States is:

1. In an electrical circuit having a semiconductor switching inverter for operating a gaseous discharge lamp from a DC energy source, a circuit arrangement for starting the lamp while in the inverter circuit, comprising:

a trigger electrode mounted in close proximity to the lamp for capacitively coupling pulsed high voltage to the lamp;

a high voltage energy source connected to the trigger electrode for supplying pulsed high voltage to the lamp; and means for locking the inverter in a constantly conductive, single polarity output mode until the lamp starts.

2. The starting circuit arrangement of claim 1 further comprising:

means for preventing high voltage pulsing of the trigger electrode after lamp ionization while the inverter is free-running.

3. The starting circuit arrangement of claim 2 further comprising:

a coupling impedance connected serially in circuit between the high voltage energy source and the trigger electrode.

4. The starting circuit arrangement of claim 2 wherein the semiconductor switching inverter is directly coupled to the gaseous discharge lamp.

5. The starting circuit arrangement of claim 2 wherein the high voltage energy source is a pulse generator of the capacitive discharge, pulse transformer type.

6. The starting circuit arrangement of claim 2 wherein the means for locking includes a first logic gate serving to lock the inverter in a constantly conductive, single polarity, output mode that the inverter will not switch until the lamp starts.

7. The starting circuit arrangement of claim 6 wherein the means for preventing includes a second logic gate serving to inhibit the high voltage energy source when the lamp is operational.

8. In an electrical circuit for operating a gaseous discharge lamp from a DC energy source, the circuit being of the type including a bridge inverter having two diagonal pairs of transistor switches arranged for connection across the DC source such that the lamp may be connected in circuit across the energy source alternately serially between diagonal pairs thereof, a circuit arrangement for starting the lamp while in the bridge inverter circuit, comprising:

a trigger electrode placed physically in close proximity to the lamp for capacitively coupling high voltage pulse energy to the lamp;

a high voltage energy source connected to the trigger electrode for supplying pulsed high voltage thereto;

means for maintaining one of the diagonal pairs of transistor switches in the conduction state while maintaining the other diagonal pair of transistor switches in the non-conduction state during high voltage pulsing at lamp starting; and means for preventing high voltage pulsing of the trigger electrode after lamp ionization while the bridge inverter is free-running.

9. The gaseous discharge lamp starting circuit arrangement of claim 8 further including a coupling impedance connected serially in circuit between the high voltage energy source and the trigger electrode.

10. The gaseous discharge lamp starting circuit arrangement of claim 8 wherein the high voltage energy source is a pulse generator of the capacitive discharge, pulse transformer type.

11. The gaseous discharge lamp starting circuit arrangement of claim 8 wherein the means for maintaining includes a first logic gate serving to lock the bridge inverter in a constant mode that the bridge inverter will not switch until the lamp starts.

12. The gaseous discharge lamp starting circuit arrangement of claim 8 wherein the means for preventing includes a second logic gate serving to inhibit the high voltage energy source when the lamp is operational.

13. In an electrical circuit having a transistor switching, bridge inverter directly coupled to a linear metal halide arc discharge lamp for operating the lamp from a DC energy source, a circuit arrangement for starting the lamp while in the inverter circuit, comprising:

a trigger electrode mounted in close proximity to the lamp for capacitively coupling pulsed high voltage to the lamp;

a pulse generator connected to the electrode for supplying pulsed high voltage thereto;

a phase splitter driver connected to the inverter for developing a signal to drive the inverter;

a pulse width modulator connected to the phase splitter driver for producing, when enabled, a variable pulse train having a fast rise and fall time for delivery to the phase splitter driver;

a first logic gate connected between the pulse width modulator and the phase splitter driver, the logic gate responsive to lamp current to lock the driver in a constant mode until the lamp starts; and a second logic gate connected to the pulse generator, the logic gate being responsive to lamp current to inhibit the generator when the lamp is on.

14. The lamp starting circuit arrangement of claim 13 further including current sensing means for sensing lamp current, the sensing means connected to the first and second logic gates.

15. The lamp starting circuit arrangement of claim 13 further including a differential amplifier responsive to the differences in light sensed at opposite ends of the lamp, the amplifier connected to the pulse width modulator for control thereof.

16. The lamp starting circuit arrangement of claim 13 further including a starting means connected to the pulse width modulator for the enabling thereof.

17. The lamp starting circuit arrangement of claim 13 further including a periodic waveform generator for developing an input signal for driving the pulse width modulator.

* * * * *